US006676572B2

(12) United States Patent
Wang et al.

(10) Patent No.: US 6,676,572 B2
(45) Date of Patent: Jan. 13, 2004

(54) FOLDING MECHANISM OF AN EXERCISE TREADMILL

(76) Inventors: Leao Wang, No. 1, Lane 233, Sec. 2, Charng Long Rd., Taiping (TW), 411; Peter Wu, No. 1, Lane 233, Sec. 2, Charng Long Rd., Taiwan (TW), 411

( * ) Notice: Subject to any disclaimer, the term of this patent is extended or adjusted under 35 U.S.C. 154(b) by 279 days.

(21) Appl. No.: 09/826,773

(22) Filed: Apr. 6, 2001

(65) Prior Publication Data

US 2002/0147077 A1 Oct. 10, 2002

(51) Int. Cl.[7] ..... A63B 22/02
(52) U.S. Cl. ..... 482/54
(58) Field of Search ..... 482/51, 54, 148; 248/188.1, 649

(56) References Cited

U.S. PATENT DOCUMENTS 5,626,538 A * 5/1997 Dalebout et al. ..... 482/54
5,868,648 A * 2/1999 Coody et al. ..... 482/54
6,077,200 A * 6/2000 Lin ..... 482/54
6,189,846 B1 * 2/2001 Wang ..... 248/188.1
6,273,843 B1 * 8/2001 Lo ..... 482/54
6,419,612 B1 * 7/2002 Yu ..... 482/54

* cited by examiner

*Primary Examiner*—Stephen R. Crow
(74) *Attorney, Agent, or Firm*—Troxell Law Office PLLC; Kuo-Hsiung Chiu

(57) ABSTRACT

The present invention relates to a folding mechanism of an exercise treadmill having a treadmill frame and a support frame. A connecting rod is mounted on the support frame and extends to the front lower side of the exercise treadmill such that the other end of the connecting rod is pivotally connected the front portion of the treadmill frame. In addition, a ground touching roller is mounted to either side of the front end of the bottom of the treadmill frame. When the rear end of the treadmill frame is lifted to perform a folding action, the ground touching rollers are operative to facilitate the lifting action of an operator such that the operation is easy and has a labor-saving effect.

2 Claims, 5 Drawing Sheets

FOLDING MECHANISM OF AN EXERCISE TREADMILL

BACKGROUND OF THE INVENTION

1. Field of the Invention

The present invention relates to a folding mechanism of an exercise treadmill, and more particularly, to a mechanism by which the exercise treadmill can be easily folded for convenient storage.

2. Description of the Prior Art

The present invention is a continuation-in-part of U.S. patent application Ser. No. 09/182237. In the prior art fold-up exercise treadmill, the operator has to support all of the weight of the treadmill in folding-up the treadmill. In brief, the prior art fold-up exercise treadmill doesn't have any members for relieving the loading of the operator in lifting up the treadmill base. Especially, it's not an suitable for operators with worse physical condition.

SUMMARY OF THE INVENTION

It is a primary object of the present invention to remove the above-mentioned drawbacks and to provide a folding mechanism of an exercise treadmill which can relieve the loading of the operator in lifting up the treadmill base, thereby reaching the easy and labor-saving effect.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
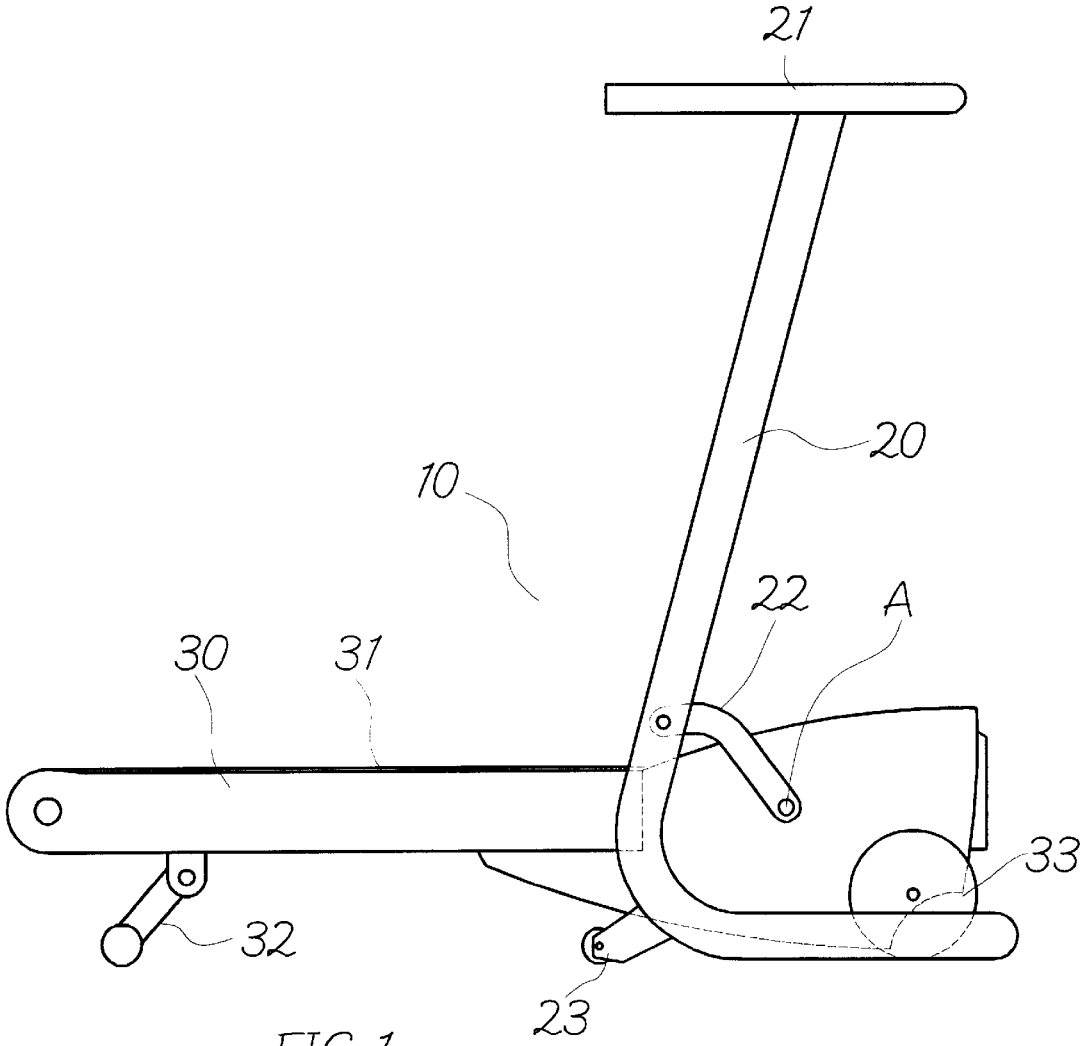
FIG. 1 is a side view of a preferred embodiment of the present invention after assembly.

First of all, referring to FIG. 1, the exercise treadmill 10 in accordance with the present invention includes a support frame 20 and a treadmill frame 30. An electronic console 21 is fitted to the support frame 20 while the treadmill frame 30 has a treadmill walking belt 31 and a drive mechanism (not shown) which drives the treadmill walking belt 31. A swivel foot roller 32 is disposed at either side of the rear end of the treadmill frame 30.

A connecting rod 22 is mounted on the support frame 20 and extends to the front lower side of the exercise treadmill 10 such that the other end thereof is pivotally connected the front portion of the treadmill frame 30. In addition, a ground touching roller 33 is mounted to either side of the front end of the bottom of the treadmill frame 30.

Figure 2:
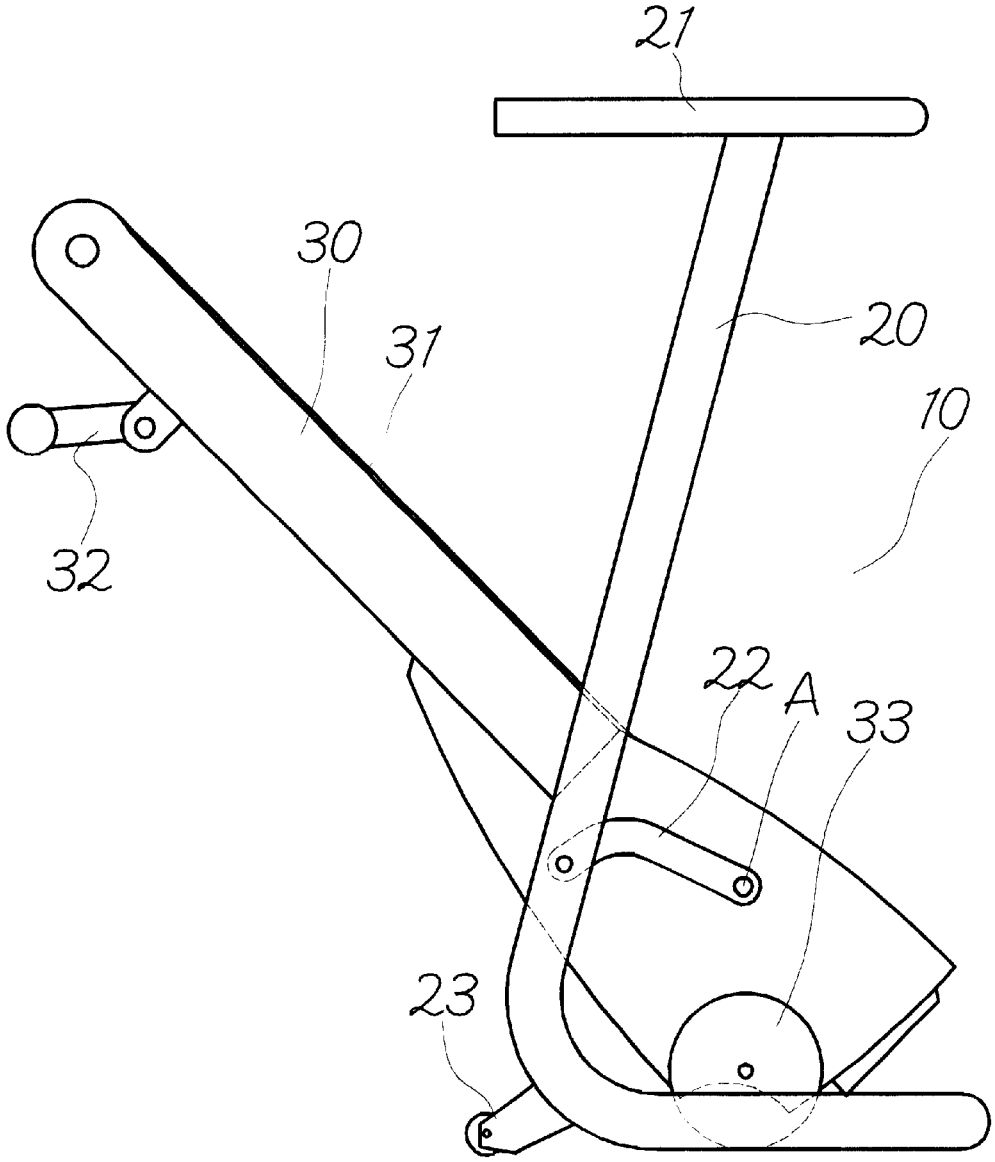
FIG. 2 is a side view of the present invention showing the fold-up action thereof.
Figure 3:
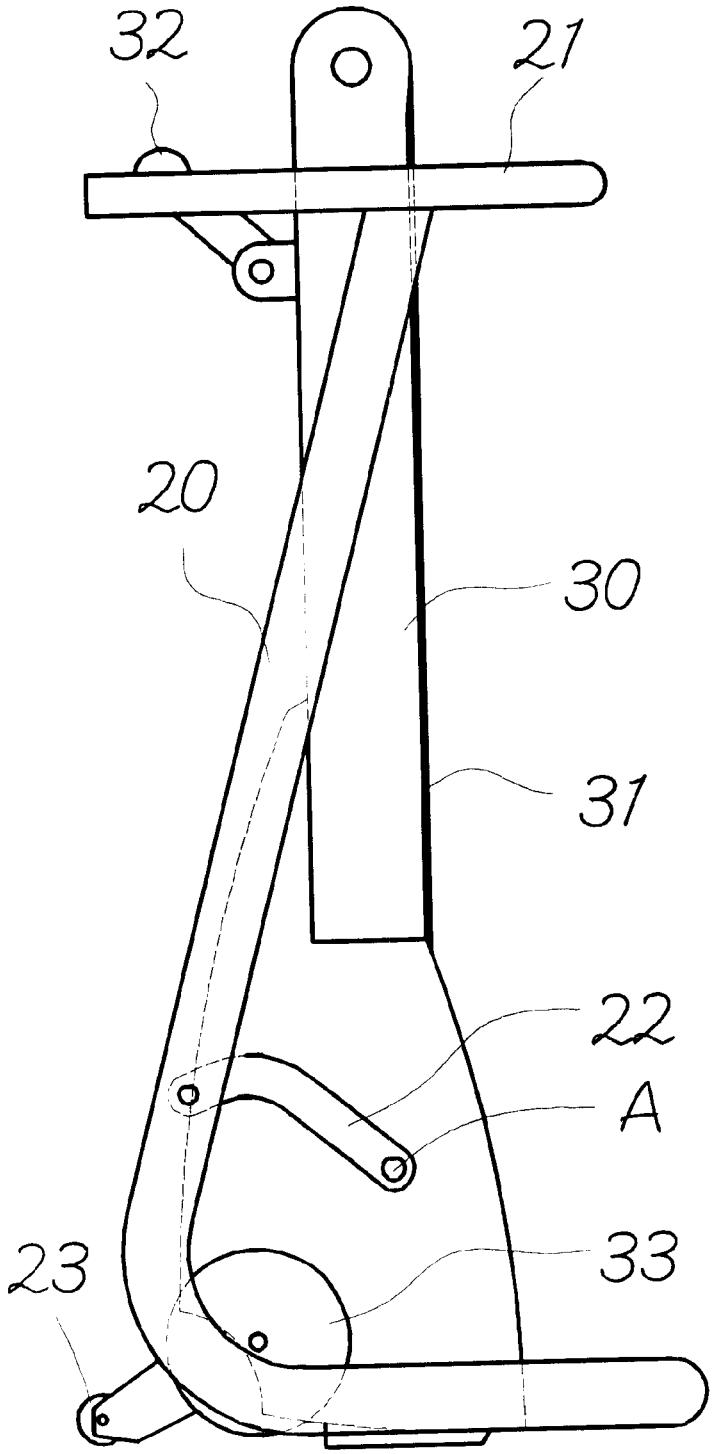
FIG. 3 is a side view of the present invention in fold-up state.

After the assembly of the aforementioned members, as shown in FIGS. 2 and 3, when the rear end of the treadmill frame 30 is lifted to perform a folding action, the connecting rod 22 and the treadmill frame 30 rotate on the pivot point A. Meanwhile, the rollers 33 at both sides of the treadmill frame 30 slide backward until the treadmill frame 30 uprightly stands in a stable fold-up state, thereby reaching the easy and labor-saving effect.

Figure 4:
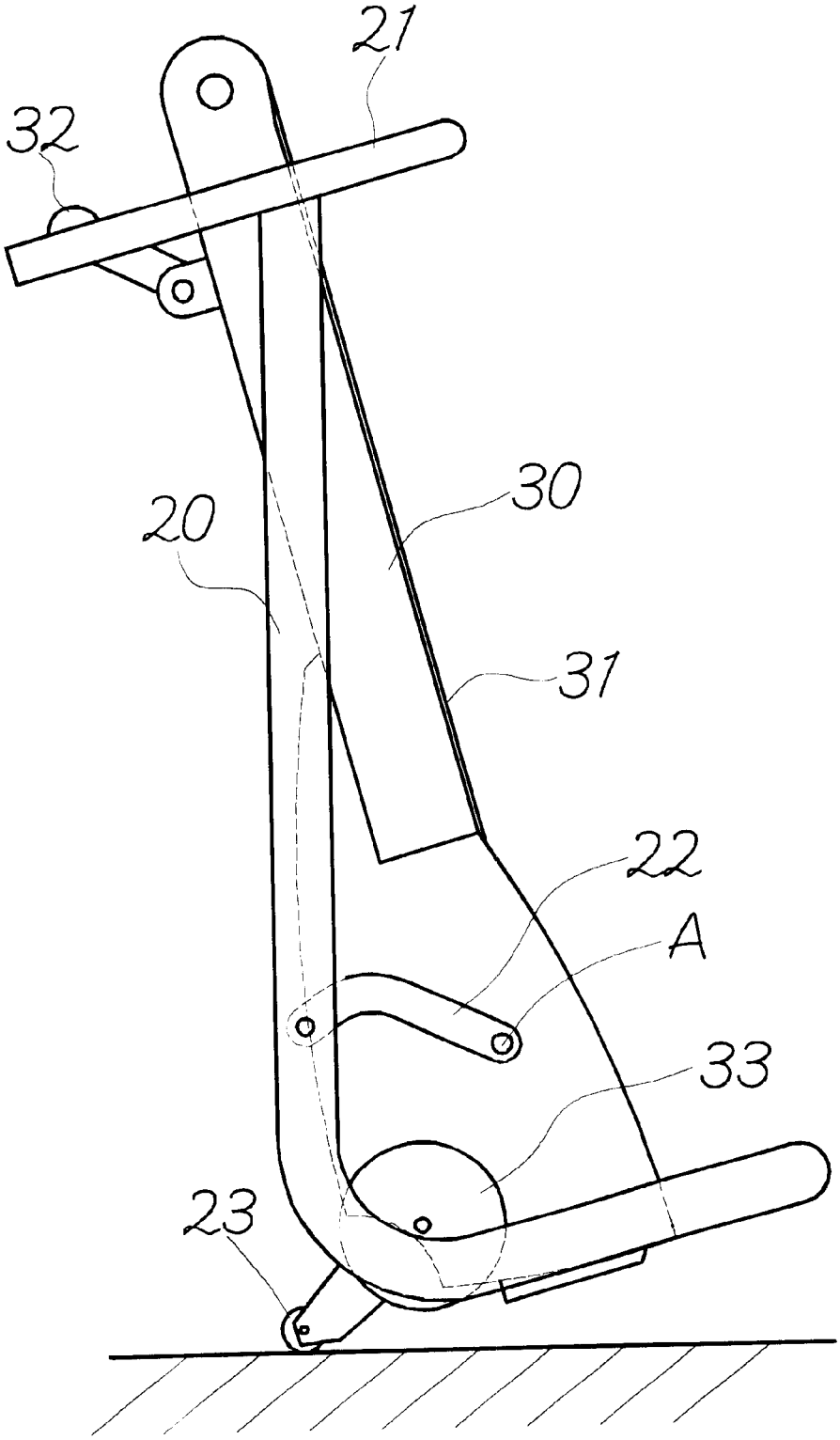
FIG. 4 is a side view of the present invention showing the unfolding action thereof.
Figure 5:
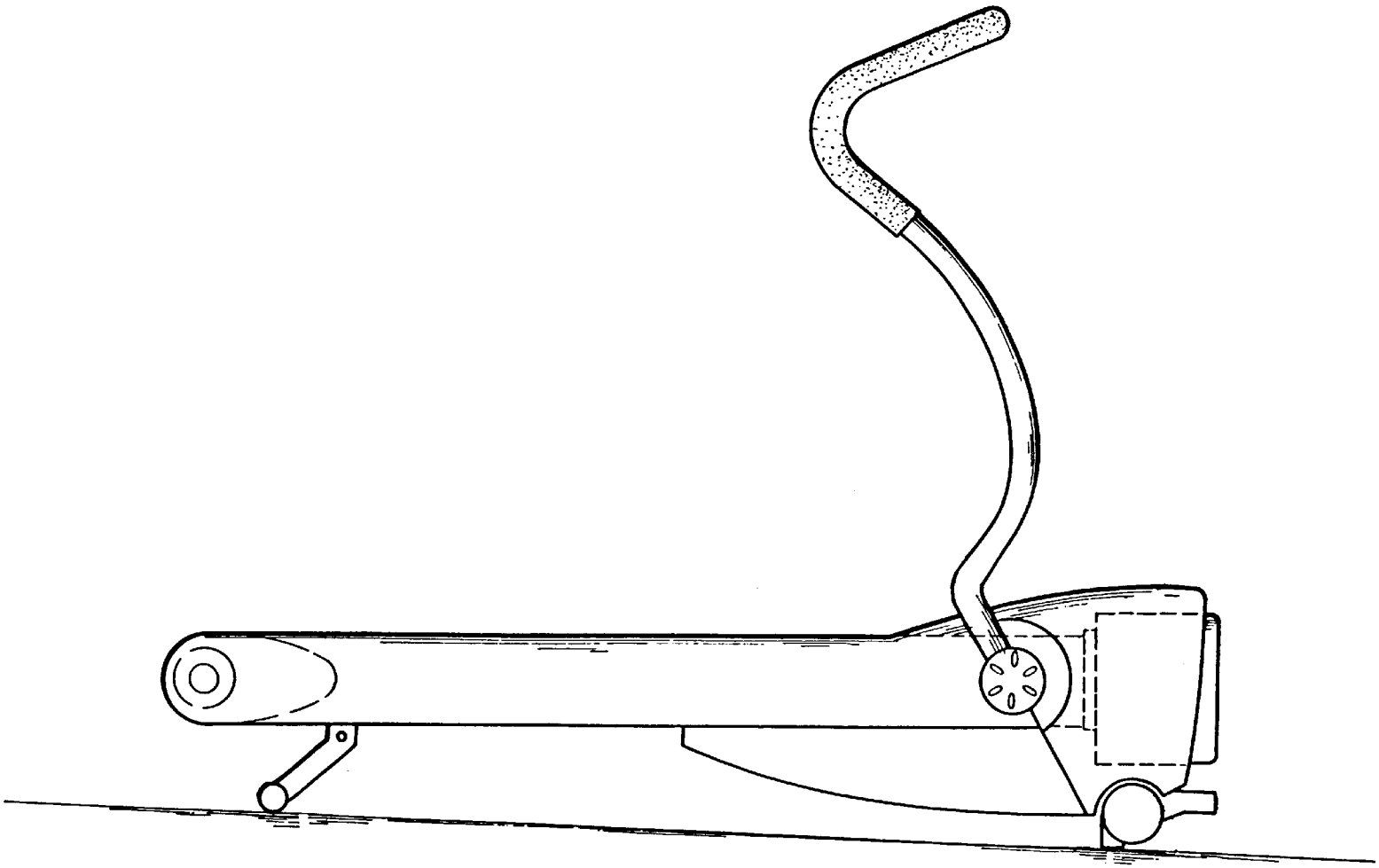
FIG.5 PRIOR ART
FIG. 5 is a side view of U.S. patent application Ser. No. 09/182237 of the inventor of the present invention.

Certainly, the exercise treadmill 10 can be situated in a stable state no matter it lies on the ground or it's folded up to an upright position. Also, an auxiliary roller 23 can be provided at either inner side of the bottom of the support frame 20. Therefore, as shown in FIG. 4, the exercise treadmill 10 can lean at a certain angle for handling it easily.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A folding mechanism of an exercise treadmill comprising:

a) a treadmill frame having a treadmill walking belt, a drive mechanism, which drives said treadmill walking belt, a swivel foot roller pivotally mounted to each side of a rear end of said treadmill frame, and a ground touching roller rotatably mounted to each side of a front end of a bottom of said treadmill frame; and, b) a support frame having an electronic console thereon; and, c) a curved connecting rod pivotally mounted at a first connecting rod end to said support frame and at a second connecting rod end to said treadmill frame, wherein the treadmill frame is rotatable relative to the support frame, whereby the support frame remains stationary and the ground touching rollers are operative to facilitate the lifting action of the user when the treadmill frame rotates between an open position for use and a closed position for storage.

2. A folding mechanism of an exercise treadmill according to claim 1, further comprising an auxiliary roller rotatably connected to each inner side of a bottom of said support frame.

* * * * *